US009035270B2

(12) United States Patent
Graebel et al.

(10) Patent No.: US 9,035,270 B2
(45) Date of Patent: May 19, 2015

(54) UNIVERSAL MOUNT

(71) Applicant: Honeywell International Inc., Morristown, NJ (US)

(72) Inventors: Kevin Graebel, Plymouth, MN (US); Stan Zywicki, III, Eden Prairie, MN (US); Stephane Joseph Pierre Beland, St-Jean-sur-Richelieu (CA)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 246 days.

(21) Appl. No.: 13/794,023

(22) Filed: Mar. 11, 2013

(65) Prior Publication Data

US 2014/0252248 A1 Sep. 11, 2014

(51) Int. Cl.

| | |
|---|---|
| ***F24F 3/16*** | (2006.01) |
| ***F24F 7/04*** | (2006.01) |
| ***F24F 13/02*** | (2006.01) |

(52) U.S. Cl.

CPC . *F24F 7/04* (2013.01); *F24F 13/02* (2013.01); *F24F 2003/1667* (2013.01)

(58) Field of Classification Search

CPC ..... F24F 2003/1667; A61L 9/20; A61L 2/10
USPC ..... 250/436, 454.11, 455.11, 504 R
See application file for complete search history.

(56) References Cited

U.S. PATENT DOCUMENTS

| | | | | |
|---|---|---|---|---|
| 2,651,383 | A | | 9/1953 | Yonkers, Jr. |
| 3,403,252 | A | | 9/1968 | Nagy |
| 3,745,750 | A | | 7/1973 | Arff |
| 4,006,354 | A | | 2/1977 | deVos et al. |
| 4,404,865 | A | | 9/1983 | Kim |
| 5,152,814 | A | | 10/1992 | Nelson |
| 5,334,347 | A | | 8/1994 | Hollander |
| 5,436,817 | A | | 7/1995 | Wotton et al. |
| 5,490,470 | A | | 2/1996 | House |
| 5,601,786 | A | | 2/1997 | Monagan |
| 5,742,063 | A | | 4/1998 | Scroggins et al. |
| 5,817,276 | A | | 10/1998 | Fencl et al. |
| 5,835,840 | A | | 11/1998 | Goswami |
| 5,866,076 | A | * | 2/1999 | Fencl et al. ..... 422/121 |
| 5,891,399 | A | | 4/1999 | Owesen |
| 5,894,130 | A | * | 4/1999 | Bach ..... 250/436 |

(Continued)

OTHER PUBLICATIONS

Fresh Aire®, "Blue Tube-UV," 2 pages, Downloaded Mar. 25, 2013.

(Continued)

*Primary Examiner* — Michael Maskell
(74) *Attorney, Agent, or Firm* — Seager, Tufte & Wickhem LLC

(57) ABSTRACT

A mount for mounting an ultraviolet (UV) lamp assembly or other device to a duct wall of an HVAC system. The mount may have a base having a first side and a second side, an aperture extending through the base from the first side to the second side, one or more first mounting features, and one or more second mounting features. To secure a UV lamp assembly to the base, the mount may have a socket allowing at least a portion of the UV lamp to extend through the aperture of the base. To secure the first side of the mount to the duct wall, the first mounting features receives connectors. To secure the second side of the mount to the duct wall, the second mounting features receive connectors. A recess between the second mounting features may facilitate connecting connectors to a duct wall without the duct wall interfering with the secured UV lamp assembly.

21 Claims, 11 Drawing Sheets

(56) References Cited

U.S. PATENT DOCUMENTS

| | | | | |
|---|---|---|---|---|
| 5,902,552 | A * | 5/1999 | Brickley | 422/121 |
| 5,920,075 | A | 7/1999 | Whitehead | |
| 6,078,712 | A | 6/2000 | Tschope et al. | |
| 6,179,969 | B1 | 1/2001 | Larsen | |
| 6,194,731 | B1 | 2/2001 | Jeys et al. | |
| 6,245,293 | B1 | 6/2001 | Fencl et al. | |
| 6,267,924 | B1 | 7/2001 | Fencl et al. | |
| 6,280,686 | B1 | 8/2001 | Scheir et al. | |
| 6,313,470 | B1 | 11/2001 | Fencl et al. | |
| 6,328,937 | B1 | 12/2001 | Glazman | |
| 6,372,186 | B1 | 4/2002 | Fencl et al. | |
| 6,423,882 | B1 | 7/2002 | Fencl | |
| 6,500,267 | B1 | 12/2002 | Fencl et al. | |
| 6,536,919 | B1 | 3/2003 | Johnson et al. | |
| 6,543,282 | B1 | 4/2003 | Thompson | |
| 6,585,809 | B1 | 7/2003 | Parsa | |
| 6,589,476 | B1 | 7/2003 | Fencl | |
| 6,627,000 | B2 | 9/2003 | Fencl et al. | |
| 6,746,134 | B1 * | 6/2004 | Guzorek | 362/647 |
| 6,939,397 | B2 | 9/2005 | Nelsen et al. | |
| 7,220,295 | B2 | 5/2007 | Lau et al. | |
| 7,318,856 | B2 | 1/2008 | Taylor et al. | |
| 7,332,124 | B2 * | 2/2008 | Trifu et al. | 422/4 |
| 7,704,463 | B2 | 4/2010 | Willette | |
| 8,007,574 | B2 | 8/2011 | Iwano et al. | |
| 2002/0191400 | A1 | 12/2002 | Jilk et al. | |
| 2003/0127506 | A1 | 7/2003 | Braun, Jr. | |
| 2004/0007134 | A1 | 1/2004 | Parsa | |
| 2005/0163653 | A1 | 7/2005 | Crawford et al. | |
| 2005/0286265 | A1 | 12/2005 | Zampini et al. | |
| 2006/0207267 | A1 * | 9/2006 | Erdman | 62/78 |

OTHER PUBLICATIONS

Honeywell, "UV100A Ultraviolet Systems," 12 pages, 2007. 68-0248-4.

* cited by examiner

UNIVERSAL MOUNT

TECHNICAL FIELD

This disclosure generally relates to mounting structures, and more particularly, to mounting structures for mounting devices to duct walls of heating, ventilation, and/or air conditioning (HVAC) systems.

BACKGROUND

HVAC systems are often used to control the comfort level within a building or other structure. Such HVAC systems typically include an HVAC controller that controls various HVAC components of the HVAC system in order to affect and/or control one or more environmental conditions within the building. The HVAC components can include, for example, a furnace and an air conditioner.

In forced air systems, the conditioned air is typically provided by a furnace and/or an air conditioner through a plenum to a network of supply air ducts that distribute the conditioned air throughout the building. A network of return air ducts is often used to return air from the building back to the furnace and/or air conditioner. A blower is used to draw the return air through the return air ducts, and drive the return air through the furnace and/or air conditioner and into the supply air ducts via the plenum. In some cases, some of the air is replaced over time with fresh outside air, often through an Energy Recovery Ventilator (ERV).

In HVAC systems, ultraviolet lights (UV) lights are sometimes used for disinfecting surfaces and volumes of air. Typically, UV lights in HVAC systems include one or more UV lamps for providing light rays in the UV C portion of the light spectrum. HVAC systems utilizing UV lights often mount the UV lights with respect to a plenum or other duct of the HVAC system in manner that allows for the UV light to disinfect the interior surfaces of the plenum and/or volumes of air passing through the plenum.

SUMMARY

This disclosure generally relates to mounting structures, and more particularly, to mounting structures for mounting devices to duct walls of HVAC systems. In one example, a mount may be provided for mounting a UV light assembly to a duct wall of an HVAC system, where the mount may be mounted on an interior wall of a duct or an exterior wall of a duct, depending on the installation. Illustratively, the mount may have a base structure having a first side, a second side opposite the first side, and an aperture extending through the base from the first side to the second side. The base may have one or more first mounting features configured to mount the base to a duct wall with the first side of the base adjacent the duct wall and one or more second mounting features configured to mount the base to a duct wall with the second side of the base adjacent the duct wall. The base may include a socket that is configured to receive a UV light assembly and secure the UV light assembly to the base with at least part of the UV light assembly extending through the aperture in the base.

In some instances, the first mounting features and/or the second mounting features may receive connectors. For example, the first mounting features may receive first connectors and the second mounting features may receive second connectors. The connectors may be magnets, adhesives, screws, rivets, and other similar or dissimilar connectors. For example, the first connector may be a screw configured to connect the mount to an exterior wall of a duct and the second connector may be a magnet configured to connect the mount to an interior wall of a duct. Alternatively, the first connector and the second connector may be screws or the first connector and the second connector may be magnets, etc. These are just some examples.

In some instances, the mount may be used in operation through connecting a UV light assembly and optionally an odor bar to the base of the mount, and selecting whether to connect the mount to the duct at an exterior wall of the duct or whether to connect the mount to the duct at an interior wall of the duct. If the mount is to be connected to an exterior wall of the duct, holes may be formed in the duct wall to receive a UV light bulb of the UV light assembly and/or the odor bar. If the mount is to be connected to an interior wall of the duct, slits may be formed in insulation on the interior of the duct (if insulation is provided) for receiving the second mounting features of the base when the mount is attached to the interior wall of the duct. Once the duct has been prepared, the mount may be connected to the selected portion of the duct.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may be more completely understood in consideration of the following description of various embodiments in connection with the accompanying drawings, in which.

Figure 1B:
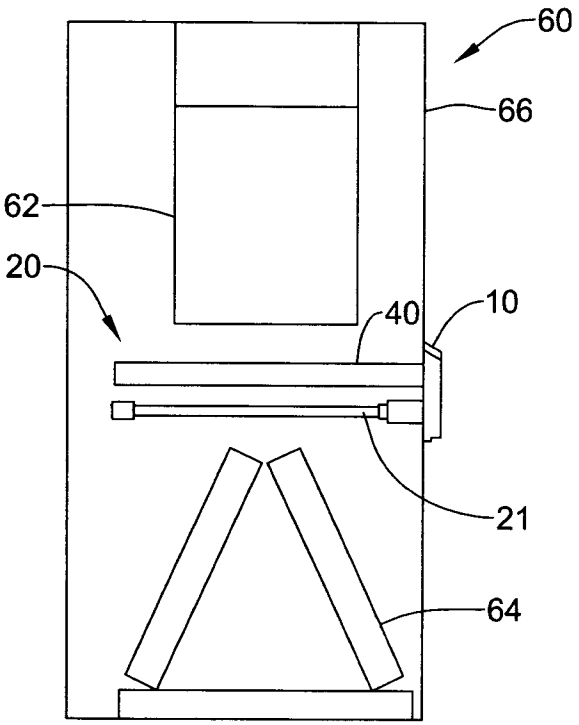
FIG. 1B is a schematic side view of an illustrative UV light assembly and UV light assembly mount attached to an exterior duct wall of an HVAC system.

While the disclosure is amenable to various modifications and alternative forms, specifics thereof have been shown by way of example in the drawings and will be described in detail. It should be understood, however, that the intention is not to limit aspects of the disclosure to the particular embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements throughout the several views. The description and drawings show several examples that are meant to be illustrative in nature.

For convenience, the present disclosure may be described using relative terms including, for example, left, right, top, bottom, front, back, upper, lower, up, and down, as well as others. It is to be understood that these terms are merely used for illustrative purposes and are not meant to be limiting in any manner.

While a light assembly (e.g., a UV light assembly) is used as one example device that may be mounted to a duct using the mounted structure described herein, it is contemplated that the mounting structure may be used to mount any suitable device as desired, including various sensors, actuators, odor bars, and other devices.

Referring to FIG. 1, some HVAC systems 60 utilize a light assembly 20 (e.g., a UV light assembly) to disinfect surfaces of the system and/or volumes of air passing through the HVAC system 60. In some instances, a light assembly 20 may be mounted to a duct 66 of an HVAC system 60 with a mounting bracket or mount 10 that is attached to an exterior of the duct 66 or an interior of the duct 66, depending on the installation. In some instances, HVAC systems 60 may include one or more odor bars 40 configured to remove odors from air passing through the HVAC system 60.

FIGS. 1-11 show various views of an illustrative mounting bracket or mount 10 of an illustrative mounting system that may be mounted either on an interior wall of the duct 66 of the HVAC system 60 (see FIG. 1A) or on an exterior wall of the duct 66 of the HVAC system 60 (see FIG. 1B), depending on the installation. The mount 10, in some instances, may have a base 12 having a first side 12*a* and a second side 12*b*, where the second side 12*b* may be opposite the first side 12*a*. Illustratively, the base 12 may have an aperture 14 that extends through the base from, or at least substantially from, the first side 12*a* of the base 12 to the second side 12*b* of the base 12, and a socket 26 adjacent the aperture 14. In some cases, the socket 26 may be used to secure a light assembly 20 to the base 12 with at least a portion of the light assembly 20 extending through the aperture 14 and/or may allow the light assembly 20 to be secured to the base 12 in any other manner. In some instances, the base 12 may include one or more first mounting features 16 and one or more second mounting features 18 (see FIGS. 2-11).

In some cases, the mounting features 16, 18 may be configured to receive a connector 22 (e.g., a first connector 22*a*, second connector 22*b*, etc.). Generally, connectors 22 may be configured to facilitate mounting the base 12 to a wall of a duct 66 with the first side 12*a* of the base 12 facing the duct wall or with the second side 12*b* of the base 12 facing the duct wall, depending on the installation. Illustrative connectors 22 may include, but are not limited to, screws, magnets, adhesives, rivets, and other similar and dissimilar features configured to connect two features (e.g., a base 12 of a mount 10 and a wall of a duct 66). For example, in some instances, the first mounting feature 16 may be configured to receive a first connector 22*a* (e.g., a screw, a magnet 28, or other connector) and the second mounting feature 18 may be configured to receive a second connector 22*b* (e.g., a magnet 28, a screw, or other connector), where the first connector 22*a* may be a screw connector and the second connector 22*b* may be a magnet 28, the first connector 22*a* may be a magnet 28 and the second connector 22*b* may be a screw connector, the first connector 22*a* and the second connector 22*b* may be screw connectors, the first connector 22*a* and the second connector 22*b* may be magnets 28, or the connectors 22*a*, 22*b* may comprise other connector types in any combination, as desired.

Illustratively, the first mounting features 16 may take on any shape or form and/or may be configured to receive any type of connector 22 (e.g., a magnet 28, adhesive, screw, rivet, and other similar or dissimilar connectors). For example, the one or more first mounting features 16 may include a mounting hole in the base 12 that may be configured to receive a first connector 22*a* (e.g., a screw, rivet or any other connector).

In some illustrative instances, the second mounting features 18 may take on any shape or form and/or may be configured to receive any type of connector 22 (e.g., a magnet 28, adhesive, screw, rivet, and other similar or dissimilar connectors). In some cases, the second mounting features 18 may have a shape that is configured to be inserted into and/or placed through one or more openings in an insulation layer on a duct wall to aid second connectors 22*b* to attach to the duct wall. For example, each of the second mounting features 18 may be elongated along a length and/or extend from a main surface, such that the second mounting feature 18 may be configured to be slid into or otherwise inserted through a linear slit (e.g., where the linear slit may be at least as long as a length L of the second mounting feature 18) or other opening in an insulation layer on a duct wall.

Figure 2:
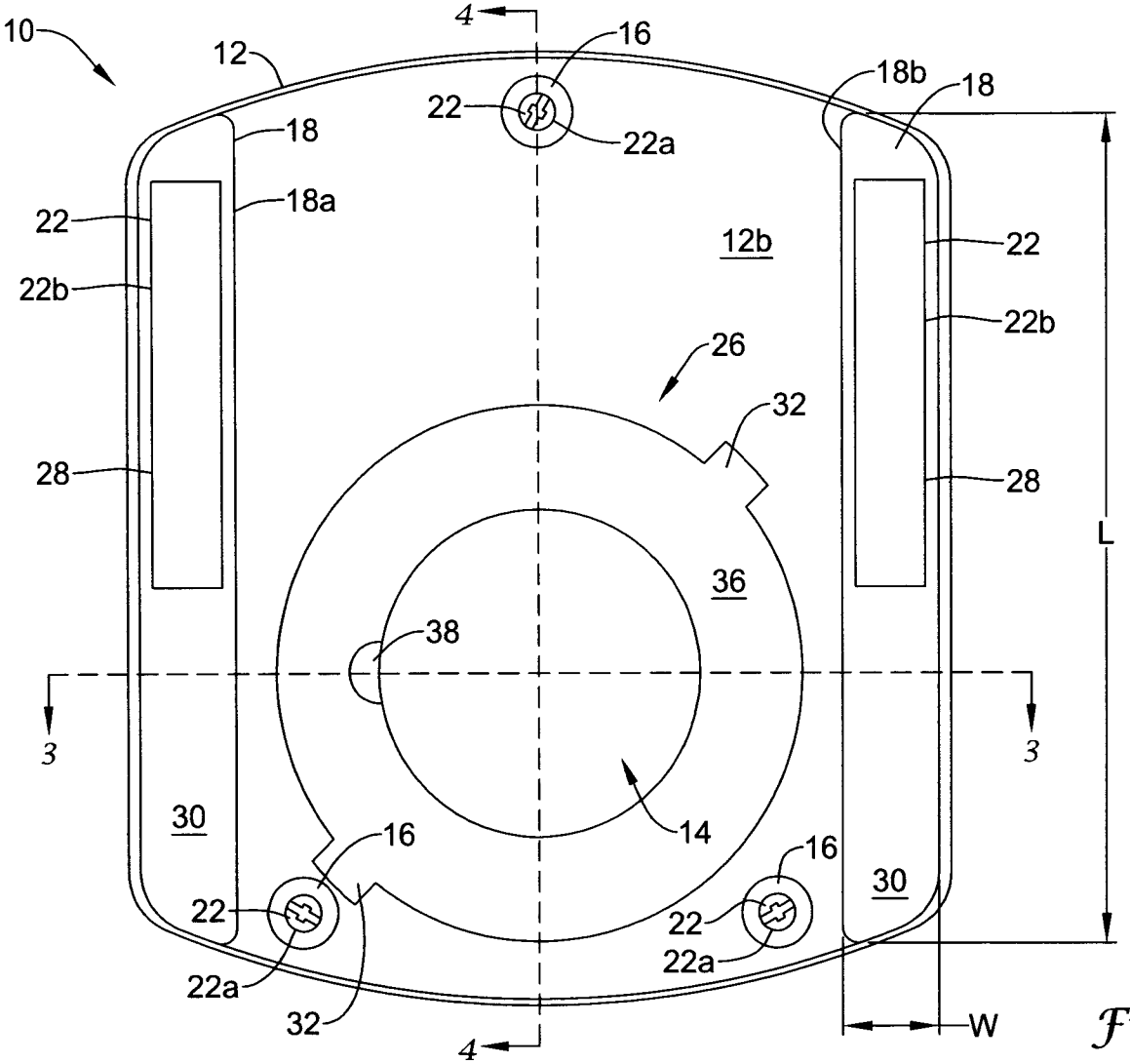
FIG. 2 is a schematic side view of an illustrative UV light assembly mount.
Figure 3:
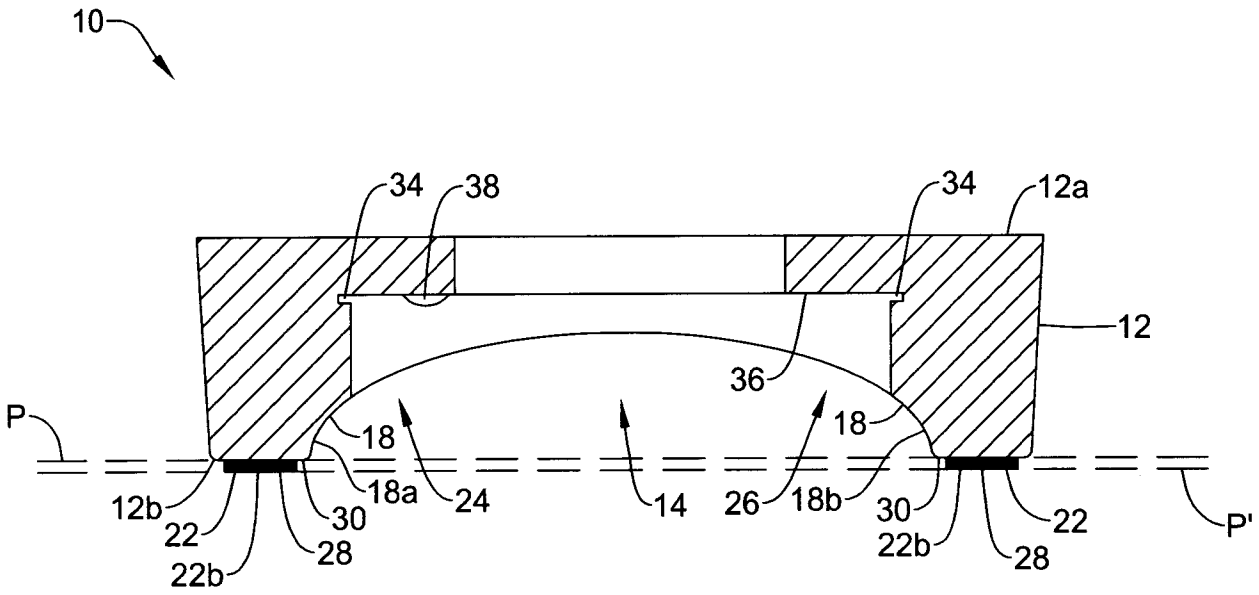
FIG. 3 is a schematic cross-sectional view of the illustrative UV light assembly mount of FIG. 2, taken along line 3-3 in FIG. 2.
Figure 4:
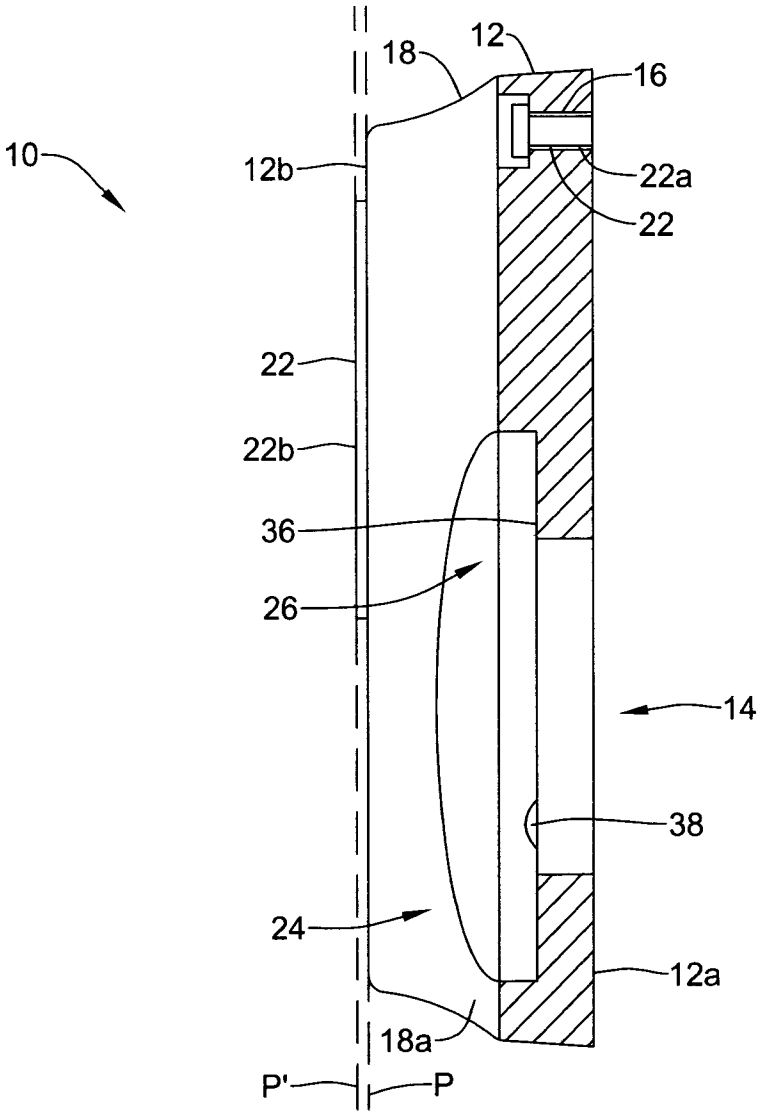
FIG. 4 is a schematic cross-sectional view of the illustrative UV light assembly mount of FIG. 2, taken along line 4-4 in FIG. 2.
Figure 5:
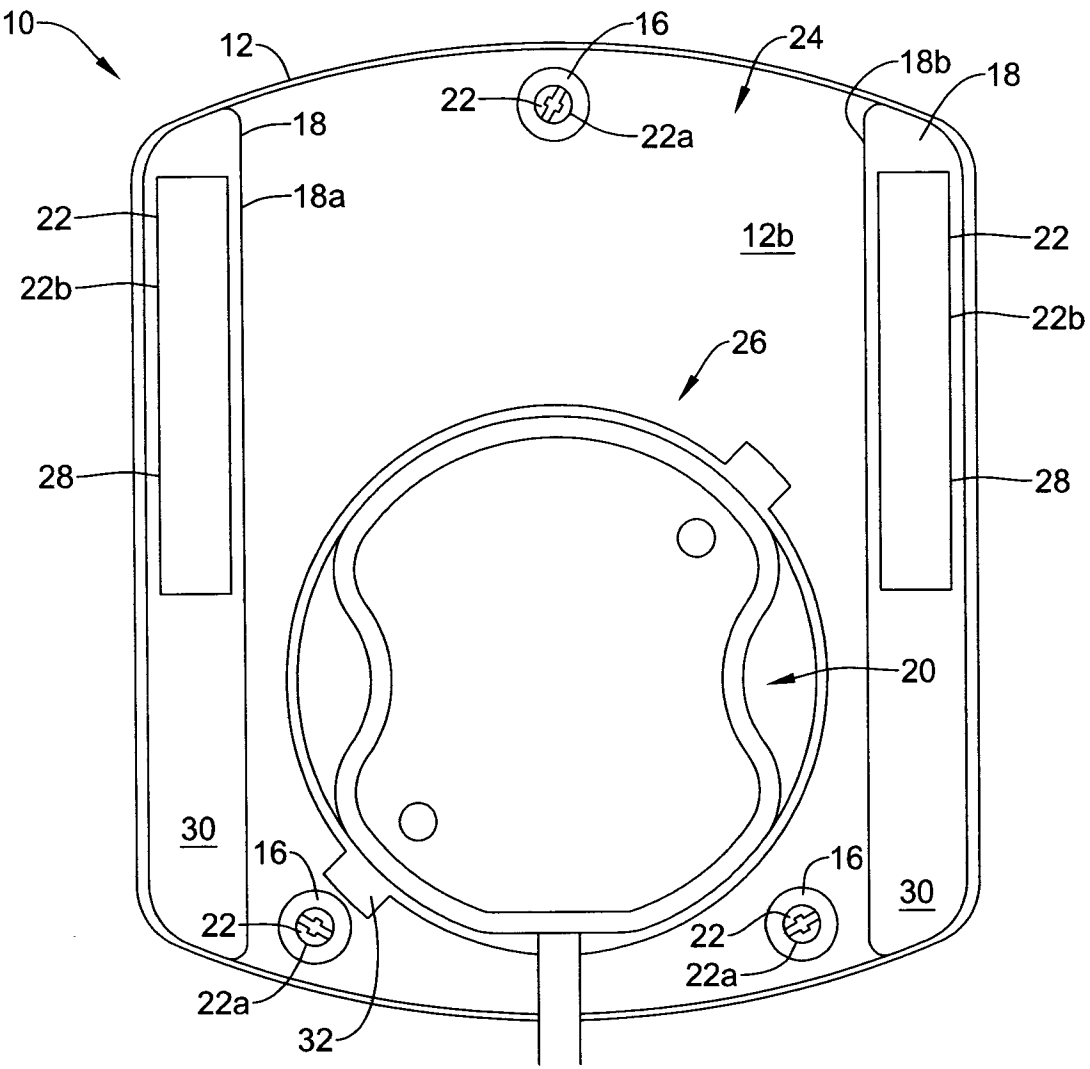
FIG. 5 is a schematic side view of the illustrative UV light assembly mount of FIG. 2 with an illustrative UV light assembly engaging the illustrative UV light assembly mount.

In some instances, the second side 12*b* of the base 12 may have at least one recess 24 (e.g. see FIG. 3). Illustratively, the recess(es) 24 may be recessed relative to one or more second mounting features 18. In some cases, the recess(es) 24 may be formed in or on the second side 12*b* of the base 12 and may be set back or recessed from a terminating end 30 of the second mounting features 18 toward the first side 12*a* of the base 12 (e.g., the recess 24 may be recessed back toward the first side 12*a* of the base 12 relative to the terminating ends 30 of two or more spaced apart second mounting features 18*a*, 18*b*, as best shown in FIGS. 2 and 3). Illustratively, the base 12 may include one second mounting feature 18, two second mounting features 18 (e.g., a first second mounting feature 18*a* and a second mounting feature 18*b*), or more than two mounting features 18, and the recess 24 may be formed at least substantially therein or therebetween or at least adjacent thereto the second mounting features 18. For example, the second mounting feature 18 may be a single second mounting feature 18 and substantially or at least partially enclose the recess 24, or the second mounting feature 18 may be more than three second mounting features 18 with recess 24 at least partially or substantially formed therebetween.

Regardless of how many second mounting features 18 are configured on the second side 12*b* of the base 12, at least one or more of the second mounting features 18 may receive a connector 22 (e.g., a second connector 22*b*). In some instances, the second connectors 22*b* may be a magnet 28 or other connecting mechanism (e.g., adhesive, screw, rivet, and other similar or dissimilar connectors). In some cases where there may be two second mounting features 18, each of the first second mounting feature 18*a* and the second mounting feature 18*b* may receive a second connector 22*b* (e.g., a magnet 28). For example, where the mount 10 may include two or more spaced second mounting features 18, each of the two or more spaced mounting features 18 may have a corresponding magnet 28. Where a magnet 28 is used as the second connector 22*b*, the magnet(s) 28 may be connected to the second mounting features 18 in any manner, for example, the magnet(s) 28 may be connected to the second mounting features 18 via a snap connection, adhesive connection, screw connection, hook connection, or any other similar or dissimilar connection type.

Illustratively, the second mounting features 18 may include the terminating end 30. The terminating end 30 may be a portion of the second mounting features 18 that is configured to receive one or more second connector 22*b* (e.g., magnets 28) and to face a duct wall when the base 12 is mounted to or is to be mounted to the duct wall. In some cases, each of, or at least some of, the terminating ends 30 of the second mounting features 18 may lie in substantially the same or common plane P, as best shown in FIG. 3. Additionally, or alternatively, the second connector(s) 22*b* received at the terminating end(s) 30 may lie in substantially the same or common plane P', as best shown in FIG. 3. In some cases, the same or common plane P of the terminating ends 30 may be substantially parallel to the same or common plane P' of the second connectors 22*b*.

The terminating end 30 of the second mounting features 18 may have a length L and a width W, and where the second mounting feature 18 may be elongated, the length L may be equal to or greater than the width W (e.g., see FIG. 2). For example, where the terminating end 30 has a length L and a width W, the length L may be equal to the width W, the length L may be greater than the width W, the length L may be at least two times greater than the width W, the length L may be at least three times greater than the width W, the length L may be at least four times greater than the width W, the length L may be at least five times greater than the width W, the length L may be at least 10 times greater than the width W, the length L may be between 1-5 times greater than the width W, the length L may be between 1-10 times greater than the width W.

In some cases, when the light assembly 20 is secured to the base 12 via the socket 26 or other feature of the mount 10, the light assembly 20 may be configured to lie in the recess 24 such that it does not interfere with the second connector 22*b* engaging the duct wall (e.g., a planar duct wall or non-planar duct wall). For example, the recess 24 that may be recessed back toward the first side 12*a* of the base 12 relative to the terminating ends 30 of the second mounting features 18 (e.g., the terminating ends 30 of two or more spaced second mounting features 18) may be configured to accommodate the light assembly 20 when the light assembly 20 is secured to the base via the socket 26 or other structure such that the light assembly 20 may not interfere with the second connectors 22*b* engaging a duct wall (e.g. see FIGS. 2 and 6).

Figure 6:
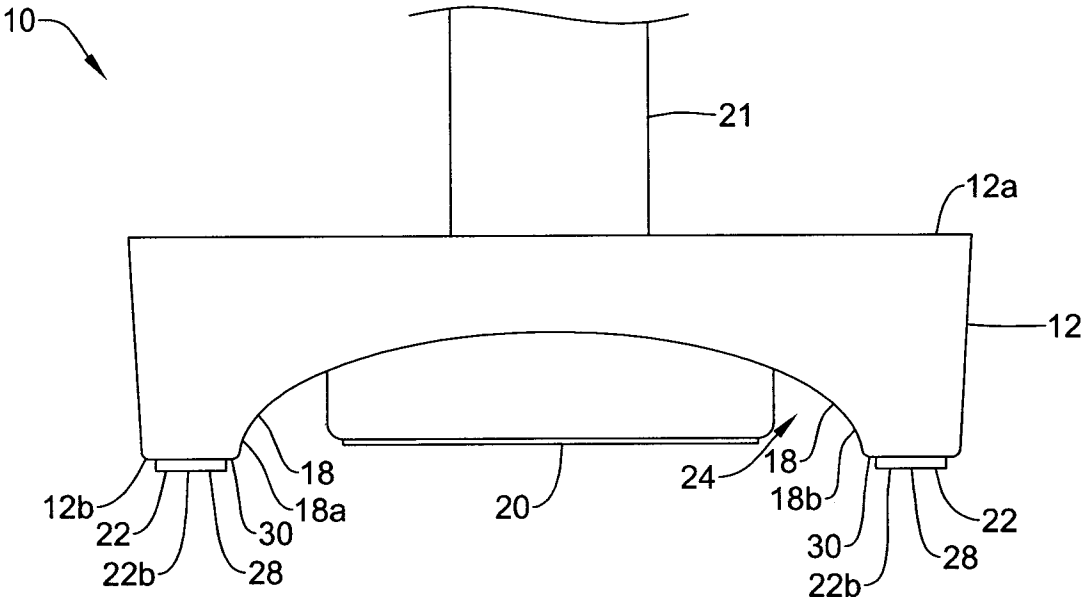
FIG. 6 is a schematic top view of the illustrative UV light assembly mount and illustrative UV light assembly of FIG. 5.
Figure 7:
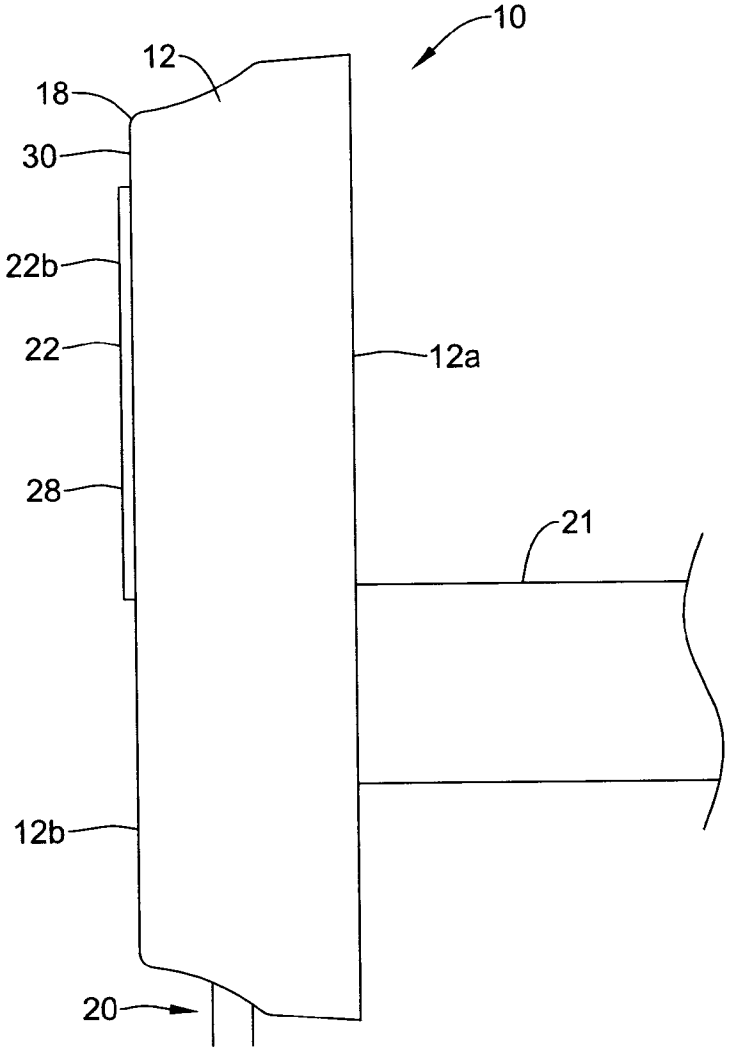
FIG. 7 is a schematic side view of an illustrative UV light assembly mount and Illustrative UV light assembly of FIG. 5.

Illustratively, the socket 26 may be formed at least partially within the recess 24 or may be formed in any other portion of the base 12 and may be positioned adjacent to, or situated as part of, aperture 14. For example, the socket 26 may include one or more slots 32, as best shown in FIGS. 2 and 6, in communication with one or more slits 34, as best shown in FIG. 3, such that the socket 26 may receive the light assembly 20, the aperture 14 may receive UV light bulb 21, and tabs extending from the light assembly 20 may fit within slots 32. In some cases, when the light assembly 20 has been inserted into the socket 26, once it abuts, or at least partially abuts, the ledge 36 of recess 24, and when its tabs are positioned within the slots 32, the light assembly 20 may be rotated such that the tabs may be slid within the slits 34. This may be considered a bayonet style connector. In some instances, the socket 26 may include a locking mechanism. For example, illustrative locking mechanism may include, among others, a bayonet lock, a ball-detent lock, or other locking mechanisms configured to be effected through rotation of the light assembly 20 and/or base 12 or other similar or dissimilar locking mechanism. Alternatively or in addition, the socket 26 and/or mount 10 may include one or more locking mechanisms to secure the light assembly 20 in one or more positions with respect to the mount 10, if desired.

Figure 8:
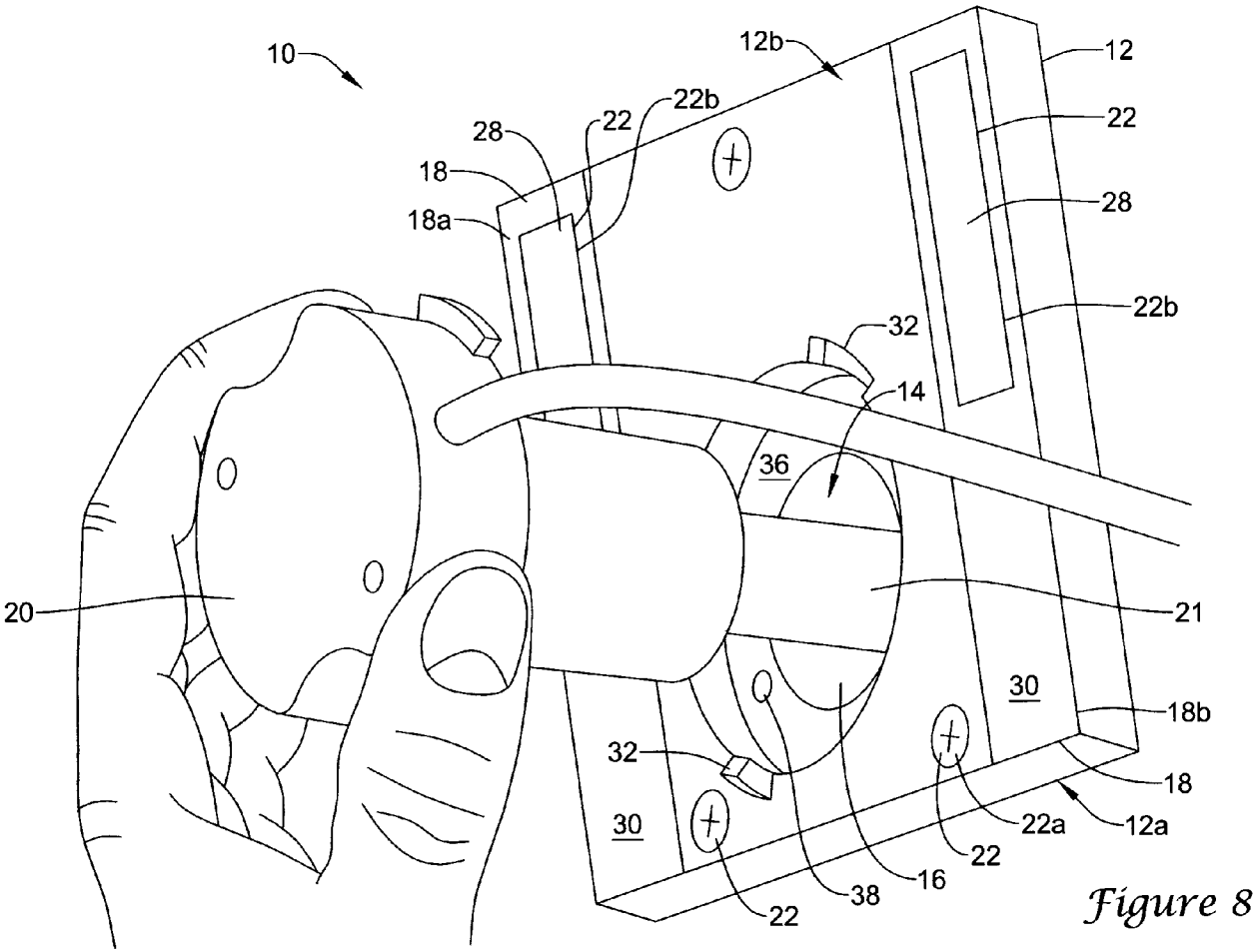
FIG. 8 is a schematic perspective view of a user placing an illustrative UV light assembly into an illustrative UV light assembly mount.

In some cases, the mount 10 may include a safety interlock feature 38 configured to interact with the light assembly 20 (see, for example, FIGS. 2 and 8). Illustratively, the safety interlock feature 38 may be configured to interact with a switch (not shown) located on the light assembly 20, where the switch may be configured to control the flow of power to a UV light bulb 21 of the light assembly 20. For example, when the light assembly 20 has been inserted into the recess 24 of the base 12, the light assembly 20 may be configured to abut ledge 36 on which the safety interlock feature 38 may be positioned and may be rotated within the slit 34 to engage the locking mechanism to lock the light assembly 20 in place with respect to the base 12, such that the switch on the light assembly 20 may engage the safety interlock feature 38 to allow power to pass to the UV light bulb 21. Similarly, when the light assembly 20 is rotated out of slit 34, the switch of the light assembly 20 may disengage the safety interlock feature 38 and thus, block power to the UV light bulb 21. Generally, the safety interlock feature 38 may be utilized to prevent undesired exposure to the UV light from the UV light bulb 21 when the light assembly 20 has been mounted to the duct 66 and the light assembly 20 is removed from the base 12 of the mount 10.

Figure 10:
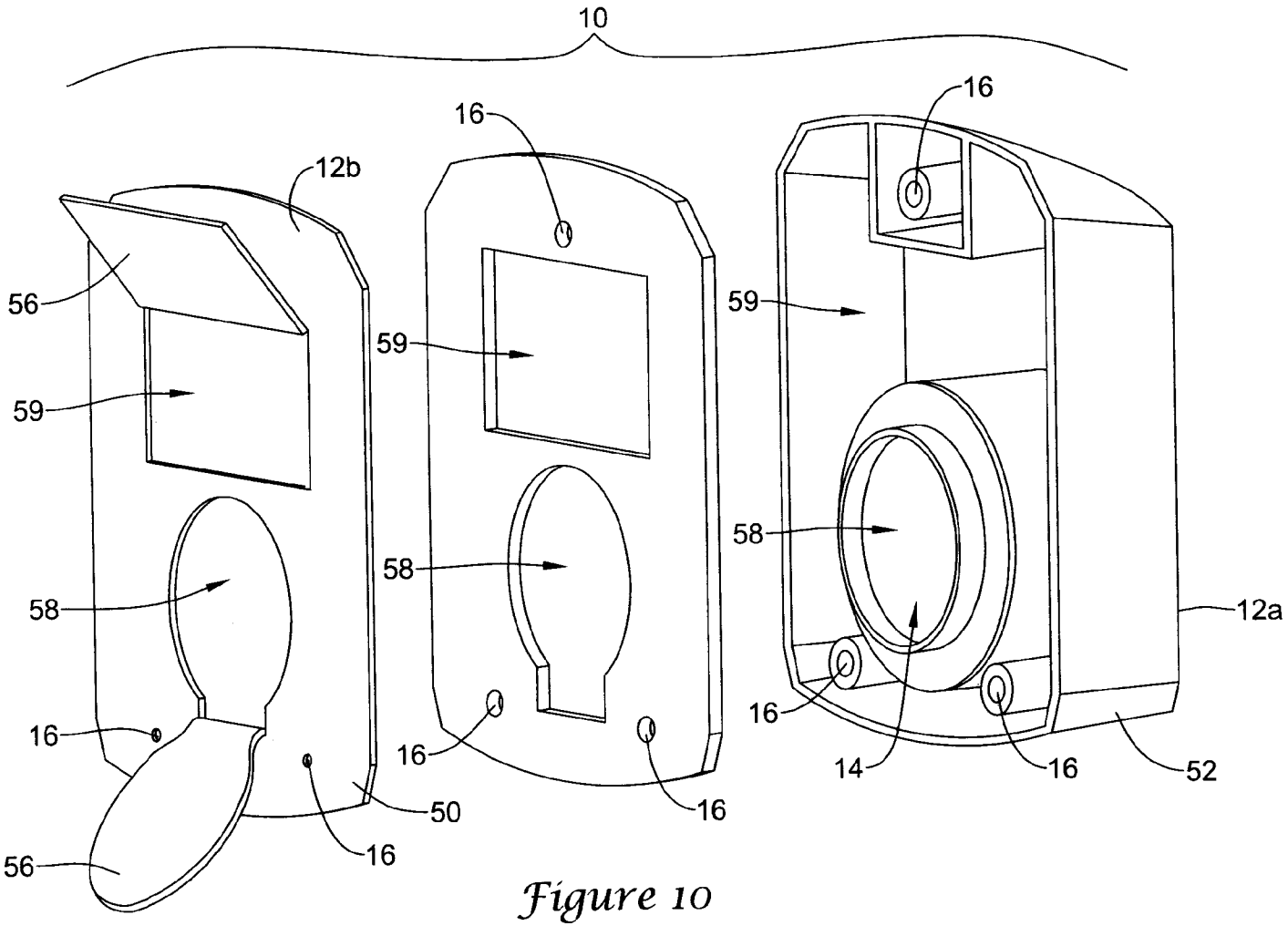
FIG. 10 is a schematic exploded view of the illustrative base of the illustrative UV light assembly mount of FIG. 9.
Figure 11:
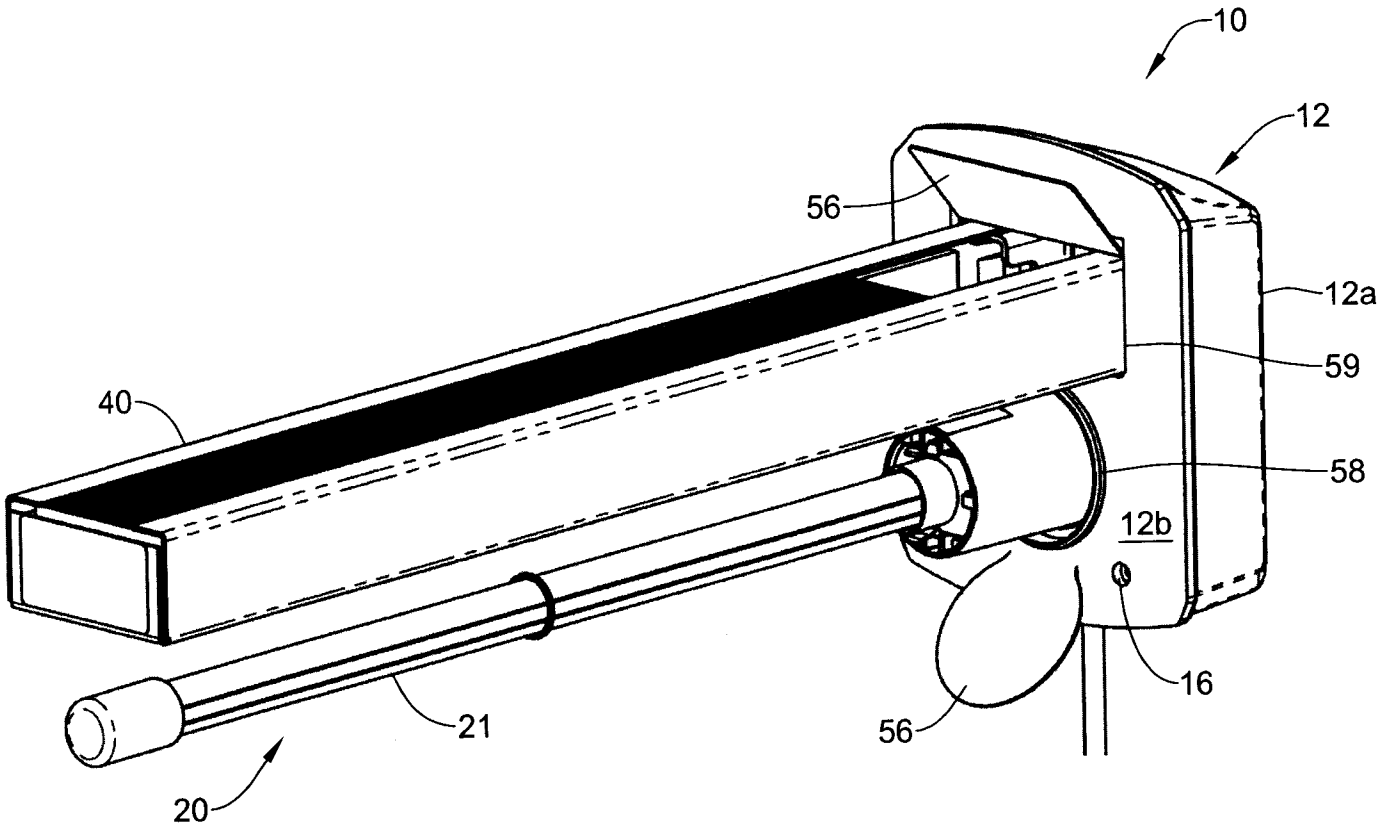
FIG. 11 is a schematic perspective top view of an illustrative UV light assembly mount with a UV light assembly and an illustrative odor bar mounted thereto.

In some instances, the mount 10 may be configured to receive one or more assemblies in addition to or as an alternative to the light assembly 20. For example, as shown in FIG. 10, the mount 10 may be configured to receive an odor bar 40, where the odor bar 40 may be configured to absorb odor in the volume of air passing through a duct 66 of the HVAC system 60 in which the odor bar 40 may be positioned. Illustratively, the first side 12*a* of the base 12 may have an opening 59 configured to receive the odor bar 40.

The opening 59 may have features configured to receive and engage odor bar 40, such that the odor bar 40 may be supported in a cantilevered manner or other manner. The features of the opening 59 configured to receive the odor bar 40 may allow the odor bar 40 to permanently engage or removably engage the opening 59. For example, the features of opening 59 may be configured to engage the odor bar in a permanent snap manner or in a releasable snap manner and the odor bar 40 and/or the opening 59 may have one or more springs or snaps configured to engage another spring or snap feature of the opening 59 and/or the odor bar 40, respectively.

Figure 9:
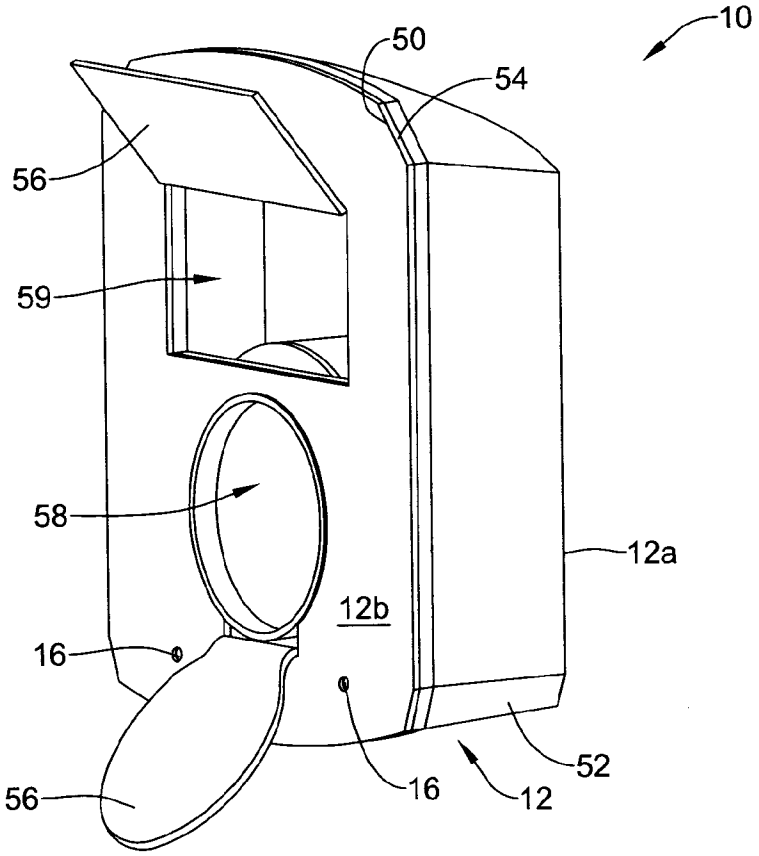
FIG. 9 is a schematic perspective view of an illustrative base of an illustratively UV light assembly mount.

Illustratively, the base 12 of the mount 10 may be a unitary piece or it may be configured of two or more pieces connected by any type of connector, as desired. For example, as shown in FIGS. 9 and 10, the base 12 of the mount 10 may include a first portion 50 and a second potion 52. In some instances, the first portion 50 may comprise a cover plate substantially defining the first side 12*a* of the base 12 and the second portion 52 may comprise a main portion that substantially defines the second side 12*b* of the base 12.

As shown in FIG. 9, the first portion 50 of the base 12 may connect to the second portion 52 of the base 12 with an adhesive connector 54. In some instances, the adhesive connector 54 may have adhesive on both sides and may be configured to adhere to the first portion 50 and the second portion 52. The adhesive connector 54 may take on any shape, for example, in some cases, the adhesive may take on the general shape of an outline of the first portion 50 of the base 12.

The first portion 50 may include one or more tabs 56 and at least a portion of the one or more first mounting features 16 configured to receive one or more first connectors 22*a*. Illustratively, tabs 56 may be configured to be bent, removed, or otherwise adjusted to provide openings 58, 59 configured to facilitate receiving the UV light bulb 21 in the base 12 and the odor bar 40 in the base 12, respectively. In some instances, the tabs 56 of the first portion 50 may be configured to bend around openings in a duct wall and into the interior of the duct to help secure the mount 10 to the duct wall, where the openings in the duct wall may correspond to and/or receive the UV light bulb 21 and/or the odor bar 40 and/or other features, as desired.

The first portion 50 may be made of any material. For example, the first portion 50 may be made of a galvanized metal, other type of metal, a plastic, or any other similar or dissimilar material, as desired. In some instances, a galvanized metal may be utilized for the first portion 50 to help provide mounting strength when the first side 12*a* of the base 12 is mounted to the duct 66 of the HVAC system 60 where creating a seal between the mount 10 and the duct may be difficult due, at least in part, to dust or mastic issues.

The second portion 52 of the base 12 may at least partially define the second side 12*b* of the base 12 and may at least partially define one or more of the first mounting features 16, the second mounting features 18, the recess 24, the socket 26, the terminating ends 30, the slots 32, the slits 34, the ledge 36, the safety interlock feature, and other features of the base 12 discussed herein.

In operation, the mount 10 may be used with a light assembly 20 to securely mount the light assembly 20 in a position with respect to a duct 66 of an HVAC system 60. Illustratively, the light assembly 20 may be inserted into the mount 10 through aperture 14, as best shown in FIG. 8. Once the light assembly 20 has been inserted into the aperture 14 of the mount 10, the light assembly 20 may be secured to the base 12 via the socket 26. Accordingly, the tabs of the light assembly 20 may be inserted into slots 32 and the light assembly 20 and/or base 12 may be rotated to a locked position with the tabs of the light assembly 20 rotated within slits 34 and releasably locked into place with one or more lock mechanisms. Alternatively, the light assembly 20 may engage and/or lock in place with respect to the base 12 or mount 10 with any other type of engagement and/or locking mechanism, as desired.

Either before or after connecting the light assembly 20 with the mount 10, a user may select between mounting the light assembly 20 to an interior of a duct 66 of an HVAC system 60 (see FIG. 1A) and mounting the light assembly 20 to an exterior of the duct 66 of the HVAC system 60 (see FIG. 1B). If the mount 10 is to be connected to an exterior wall of the duct 66, one or more holes may be formed in the duct wall to receive the UV light bulb 21 of the light assembly 20 and/or the odor bar 40 of the light assembly 20. If the mount is to be connected to an interior wall of the duct 66, one or more slits may be formed in an insulation layer on the interior of the duct 66 (if insulation is provided) for receiving the second mounting features 18 of the base 12 when the mount 10 is attached to the interior wall of the duct 66. If the user selects to mount the light assembly to the interior wall of the duct 66 of the HVAC system 60, the user may mount the light assembly 20 to the duct wall with the one or more second mounting features 18 that may receive or have a second connector 22*b* (e.g., magnet(s) 28, adhesive, screw(s), rivet(s), and other similar or dissimilar connectors). If the user selects to mount the light assembly to the exterior wall of the duct 66 of the HVAC system 60, the user may mount the light assembly 20 to the duct wall using one or more first mount features 16 and a connector 22 (e.g., a first connector 22*a* such as adhesive, screw(s), magnet(s), rivet(s), and other similar or dissimilar connectors). In one example, the one or more first mount features may include one or more mounting holes (e.g., one mounting hole, two mounting holes, three mounting holes, four mounting holes, or any number of mounting holes) and a first connector 22*a* (e.g., a screw) may be received in each of the mounting holes (e.g., one screw may be received in each of three mounting holes), such that the first connector(s) 22*a* may secure the first side 12*a* of the base 12 to the exterior duct wall.

Additionally, a user may choose to attach an odor bar 40 or other feature to the base 12 of the mount 10. For example, a user may insert an odor bar 40 through an opening 59 in the first side 12*a* of the base 12 and the odor bar 40 may have one or more features configured to snap or otherwise connect with connection features in the opening 59 of the base 12.

Figure 1A:
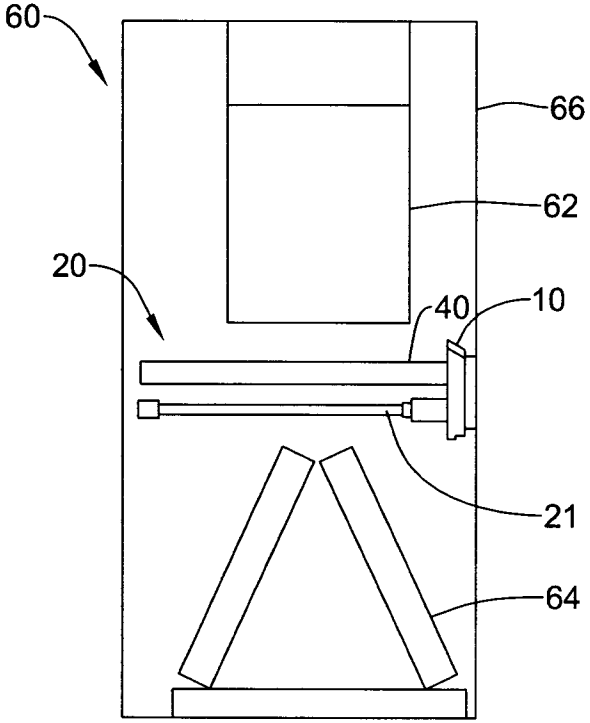
FIG. 1A is a schematic side view of an illustrative UV light assembly and UV light assembly mount attached to an interior duct wall of an HVAC system.

Generally, users may use the mount 10 to mount a light assembly 20 at any position within or about a duct 66 of an HVAC system 60. For example, the mount 10 and the light assembly 20 may be mounted to a duct at a position before an A-coil 64 of the HVAC system 60, at a position after the A-coil 64 of the HVAC system 60, at a position within the A-coil 64 of the HVAC system 60, at a position before a blower 62 of the HVAC system 60, at a position after the blower 62 for the HVAC system 60, and/or at any other position within or about the HVAC system 60. In the example and in other instances, the mount 10 may be mounted to the duct 66 at a position within the duct 66, as shown in FIG. 1A, or at position exterior the duct 66, as shown in FIG. 1B.

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A mount for mounting an ultraviolet (UV) light assembly to a duct wall of an HVAC system, the mount comprising:

a base having a first side and a second side opposite the first side;

the base defining an aperture that extends through the base from the first side to the second side;

the base having a socket for use in securing a UV light assembly to the base with at least part of the UV light assembly extending through the aperture;

the base having one or more first mounting features each configured to receive a first connector for mounting the base to a duct wall with the first side of the base facing the duct wall; and the base having one or more second mounting features on the second side of the base for mounting the base to a duct wall with the second side of the base facing the duct wall, wherein the one or more second mounting features are configured to receive a second connector, wherein the second connector includes a magnet.

2. The mount of claim 1, wherein the second side of the base has a recess relative to the one or more second mounting features such that when a UV light assembly is secured to the base via the socket, the UV light assembly does not interfere with the second connector engaging the duct wall.

3. The mount of claim 1, wherein the one or more second mounting features include two or more spaced second mounting features, each having a corresponding magnet.

4. The mount of claim 3, wherein each of the two or more spaced second mounting features are elongated along a length and are configured to be slid through a linear slit in an insulation layer on a duct wall.

5. The mount of claim 4, wherein each of the two or more spaced second mounting features have a terminating end, and the terminating end has a length and a width, where the length is greater than 3 times the width.

6. The mount of claim 5, wherein the second side of the base has a portion that is recessed back toward the first side relative to the terminating ends of the two or more spaced second mounting features.

7. The mount of claim 6, wherein the portion of the second side that is recessed back toward the first side relative to the terminating ends of the two or more spaced second mounting features is configured to accommodate the UV light assembly when the UV light assembly is secured to the base via the socket such that the UV light assembly does not interfere with the second connector engaging a duct wall.

8. The mount of claim 3, wherein each of the two or more spaced second mounting features have a terminating end facing a duct wall, wherein the terminating ends of the two or more spaced second mounting features all lie generally along a common plane.

9. The mount of claim 1, wherein the one or more first mounting features include mounting holes.

10. The mount of claim 1, wherein the socket includes a lock feature that releasably fixes the UV light assembly with respect to the base.

11. The mount of claim 1, wherein the socket includes a safety interlock feature for activating a safety interlock of the UV light assembly.

12. An ultraviolet (UV) light assembly and mount for mounting the UV light assembly to a duct wall of an HVAC system, comprising:

a UV light assembly;

a mount for mounting the UV light assembly to a duct wall of an HVAC system, the mount including:

a base having a first side and a second side opposite the first side;

the base defining an aperture that extends through the base from the first side to the second side;

the base having a socket for use in securing a UV light assembly to the base with at least part of the UV light assembly extending through the aperture;

the base having one or more first mounting features each configured to receive a connector for mounting the base to a duct wall of an HVAC system with the first side of the base facing the duct wall; and the base having one or more second mounting features on the second side of the base for mounting the base to a duct wall of an HVAC system with the second side of the base facing the duct wall.

13. The UV light assembly and mount of claim 12, wherein the second side of the base has a recess relative to the one or more second mounting features such that when the UV light assembly is secured to the base via the socket, the UV light assembly does not interfere with the second mounting features engaging a planar duct wall.

14. The UV light assembly and mount of claim 12, wherein the one or more second mounting features include two or more spaced second mounting features, each having a corresponding magnet.

15. The UV light assembly and mount of claim 14, wherein each of the two or more spaced second mounting features are elongated along a length and are configured to be slid through a linear slit in an insulation layer on a duct wall.

16. The UV light assembly and mount of claim 15, wherein each of the two or more spaced second mounting features has a terminating end, and the terminating end has a length and a width, where the length is greater than 3 times the width.

17. The UV light assembly and mount of claim 16, wherein the second side of the base has a portion that is recessed back toward the first side relative to the terminating ends of the two or more spaced second mounting features.

18. The UV light assembly and mount of claim 17, wherein the portion of the second side that is recessed back toward the first side relative to the terminating ends of the two or more spaced second mounting features is configured to accommodate the UV light assembly when the UV light assembly is secured to the base via the socket such that the UV light assembly does not interfere with the second mounting features engaging a planar duct wall.

19. The UV light assembly and mount of claim 14, wherein each of the two or more spaced second mounting features have a terminating end facing a duct wall, wherein the terminating ends of the two or more spaced second mounting features all lie generally along a common plane.

20. The UV light assembly and mount of claim 12, further comprising:

an odor bar configured to engage the first side of the base.

21. A method of mounting an ultraviolet (UV) light assembly to a duct wall of a duct using a mount having a base with a first side and a second side opposite the first side, an aperture extending through the base from the first side to the second side, a socket for use in securing the UV light assembly to the base with at least part of the UV light assembly extending through the aperture, one or more first mounting features each configured to receive a connector for mounting the base to a duct wall with the first side of the base facing the duct wall, and one or more second mounting features on the second side of the base for mounting the base to a duct wall with the second side of the base facing the duct wall, wherein the one or more second mounting features including a magnet, the method comprising:

securing the UV light assembly to the base via the socket;

selecting between mounting the UV light assembly to an interior of the duct wall and mounting the UV light assembly to an exterior of the duct wall;

mounting the UV light assembly to the duct wall with the one or more second mounting features including the magnet if mounting the UV light assembly to the interior of the duct wall is selected; and mounting the UV light assembly to the duct wall using the one or more first mounting features and a connector if mounting the UV light assembly to the exterior of the duct wall is selected.

* * * * *